US007886679B2

(12) United States Patent
De Baan

(10) Patent No.: US 7,886,679 B2
(45) Date of Patent: Feb. 15, 2011

(54) MOORING SYSTEM

(75) Inventor: Jacob De Baan, Maassluis (NL)

(73) Assignee: Bluewater Energy Services, B.V., Hoofddorp (NL)

( * ) Notice: Subject to any disclaimer, the term of this patent is extended or adjusted under 35 U.S.C. 154(b) by 165 days.

(21) Appl. No.: 12/158,342

(22) PCT Filed: Dec. 18, 2006

(86) PCT No.: PCT/EP2006/069833

§ 371 (c)(1),
(2), (4) Date: Oct. 13, 2008

(87) PCT Pub. No.: WO2007/071647

PCT Pub. Date: Jun. 28, 2007

(65) Prior Publication Data

US 2009/0020059 A1 Jan. 22, 2009

(30) Foreign Application Priority Data

Dec. 22, 2005 (EP) ..... 05112782

(51) Int. Cl.
*B63B 21/00* (2006.01)
*B63B 22/02* (2006.01)

(52) U.S. Cl. ..... 114/230.2; 441/3

(58) Field of Classification Search ..... 114/230.1, 114/230.13, 230.15, 230.2, 230.26; 441/3; 405/195.1

See application file for complete search history.

(56) References Cited

U.S. PATENT DOCUMENTS 3,668,875 A 6/1972 Sander et al.
3,841,501 A 10/1974 Heijst
5,501,625 A * 3/1996 Belinsky ..... 441/3
5,527,132 A * 6/1996 Labbe ..... 405/195.1
6,886,611 B2 5/2005 Dupont

FOREIGN PATENT DOCUMENTS

| | | |
|---|---|---|
| EP | 1400442 | 9/2003 |
| FR | 1421700 | 12/1965 |
| FR | 1465759 | 1/1967 |
| GB | 2056391 | 3/1981 |
| WO | WO 8201859 | 6/1982 |

OTHER PUBLICATIONS

Written Opinion of the European Patent Office in counterpart foreign application No. PCT/EP2006/069833 filed Dec. 8, 2006.

* cited by examiner

*Primary Examiner*—Daniel V Venne
(74) *Attorney, Agent, or Firm*—Steven M. Koehler; Westman, Champlin & Kelly, P.A.

(57) ABSTRACT

A system for mooring a vessel at an offshore site comprises at least one floating mooring element with two opposite mooring bodies for receiving therebetween and engaging the hull of the vessel. Each mooring element is movable between an upper position for engaging the hull of the vessel and a lower position in which at least one of its mooring bodies is lowered below the upper position for disengaging the hull of the vessel. Further means are provided for maintaining a substantially stationary position of the mooring element relative to the seabed. Preferably the system comprises at least two mooring elements spaced in the longitudinal direction of the vessel.

13 Claims, 9 Drawing Sheets

MOORING SYSTEM

CROSS-REFERENCE TO RELATED APPLICATION

This application is a Section 371 National Stage Application of International Application PCT/EP2006/069833 filed Dec. 18, 2006 and published as WO 2007/071647 in English.

BACKGROUND

The discussion below is merely provided for general background information and is not intended to be used as an aid in determining the scope of the claimed subject matter.

Aspects of the invention relate to a system for mooring a vessel at an offshore site.

For the offloading of tankers, in particular those that carry Liquefied Natural gas (LNG), it is at times advantageous if they can be moored offshore, in a safe and expedient manner, such that offloading can be performed well away from congested harbour and populated areas. Examples of such offshore offloading systems are known, e.g. the "Accelerate" on-board regasification project in the Gulf of Mexico. Such systems have not found application in a widespread manner.

The major issues in offloading such LNG tanker offshore are many.

For instance, to date, there are only a few (i.e. less than 1%) LNG tankers outfitted with re-gasification equipment. Gasification requires an expensive extension to each vessel such as to be able to re-gasify the cargo on board and this equipment is only required for typically 3 days per, say, 3 weeks and hence is cost-inefficient. It is much more efficient if LNG could be offloaded without the need for onboard re-gasification.

Multibuoy moorings have been in use in the offshore oil industry for decades and various vendors supply these systems, but they all suffer from significant drawbacks if bigger ships have to be moored. It takes generally many hours to fit the mooring lines between the ship and the buoys. If any of those lines was to disconnect during the offloading a dangerous situation could occur which could even lead to collision between the vessel and any the offloading equipment near the water surface.

For these reasons, most, if not all, present LNG terminals are located inside protected waters, some distance away from population centers. A standard quayside/pier arrangement is then used, such as shown in FIG. 1 of U.S. Pat. No. 6,886,611, employing rubber fenders and nylon or polyester mooring ropes to secure the vessel to the quay/pier.

Since the amount of LNG import is rising dramatically, a significant shortage of suitable vessel berths will occur in the next decade, a shortage which can be mitigated by mooring and offloading such vessels offshore.

SUMMARY

This Summary and Abstract are provided to introduce some concepts in a simplified form that are further described below in the Detailed Description. This Summary and Abstract are not intended to identify key features or essential features of the claimed subject matter, nor are they intended to be used as an aid in determining the scope of the claimed subject matter. In addition, the description herein provided and the claimed subject matter should not be interpreted as being directed to addressing any of the short-comings discussed in the Background.

An aspect of the invention to provide a temporary mooring system for any vessel, in particular for LNG vessels, ranging in size between 80 000 m3 and 200 000 m3 storage volume, which allows a vessel to be maneuvered into position by marine support vessels in exactly the same way as employed with an inshore jetty.

According one aspect of the invention, a system for mooring a vessel at an offshore site is provided, comprising at least one floating mooring element with two opposite mooring bodies for receiving therebetween and engaging the hull of the vessel, wherein each mooring element is movable between an upper position for engaging the hull of the vessel and a lower position in which at least one of its mooring bodies is lowered below the upper position for disengaging the hull of the vessel and wherein a mechanism is provided for maintaining a substantially stationary position of the mooring element relative to the seabed.

Once in position, the system is mobilised in a matter of minutes to secure the vessel in its position. Since no use is made of synthetic mooring lines to secure the vessel, the reliability of the mooring system is significantly enhanced.

The mooring system can be used in conjunction with a loading system for example a loading system as shown in FIG. 1 or FIG. 2 of U.S. Pat. No. 6,886,611.

In one embodiment, the system according to an aspect of the present invention comprises at least two mooring elements spaced in the longitudinal direction of the vessel to be engaged thereby. This offers a very reliable and stable mooring of the vessel.

Further, the mooring element can be anchored to the seabed using anchor lines. As a result the mooring element (and thus the vessel) maintains safely its position, also relative to any loading/unloading equipment (on a quayside or pier, for example).

The mooring bodies can comprise at least one buoyancy tank. The buoyancy determines the position of the floating bodies relative to the water surface. The mooring bodies then may define semi-submersible floating bodies (it even might be possible to have mooring bodies which are fully submersed in the upper position of the mooring element, but in one embodiment the mooring bodies partly are positioned above the water surface).

For lowering and rising the respective mooring body, an array of possibilities exists. For example, at least the buoyancy tank of the mooring body which can be lowered may comprise ballasting device for changing the buoyancy of the mooring body.

As an alternative, however, the mooring body which can be lowered may be provided with a hoist connected to a ballast weight.

As yet another alternative solution, the mooring body which can be lowered may be provided with a hoist connected to the seabed.

In one embodiment of the system, the mooring bodies comprise settable fender for engaging the hull of the vessel. When a vessel is positioned between the opposite mooring bodies of the mooring element(s) and the mooring element(s) has (have) assumed the upper position, the fender may be set for engaging the hull of the vessel. By way of non-limiting example the fender may be supported by cylinder-piston assemblies.

To increase the force with which the fender engages the hull (which force basically is based upon friction) it is preferred that at least some of the fenders comprise a space opening towards the hull of the vessel and with a device for lowering the pressure inside the space for creating a suction force on the hull.

In such a case the device for lowering the pressure inside the space for example may comprise a pump for pumping water out of the space. As a result of pumping water out of the space (after the fender has engaged the hull such that the space is fully closed) the pressure within the space drops with a resulting suction force on the hull of the vessel.

The integrity (and thus the correct functioning) of the system according to another aspect of the invention may be safeguarded in an easy manner when, according to yet another embodiment thereof, the two mooring bodies of the mooring element are interconnected such by a frame member that the mooring element is substantially U-shaped with the mooring bodies defining the top of the legs of the U and the frame defining the bottom of the U.

Such an embodiment of the system offers the possibility of obtaining an even more stable positioning of the vessel relative to the mooring element, for example when the frame member comprises bumpers for engaging the underside of the hull of the vessel in the upper position of the mooring element.

When, as stated above, the system comprises at least two spaced mooring elements, it can be preferable that these at least two spaced mooring elements are interconnected by connecting lines, such as anchor lines (although it also is possible that each mooring element is anchored individually and independent from the remaining mooring elements).

For preventing, in such case, undesired mutual influences between adjoining mooring elements through the connecting lines, the connecting lines extend freely movable through channels provided in the mooring elements. Still it may be wise to provide the connecting lines with a stop cooperating with the mooring elements for defining at least one position of the connecting lines relative to the mooring elements.

BRIEF DESCRIPTION OF THE INVENTION

Aspects of the invention will be further described with reference to the figures.

DETAILED DESCRIPTION

Figure 1:
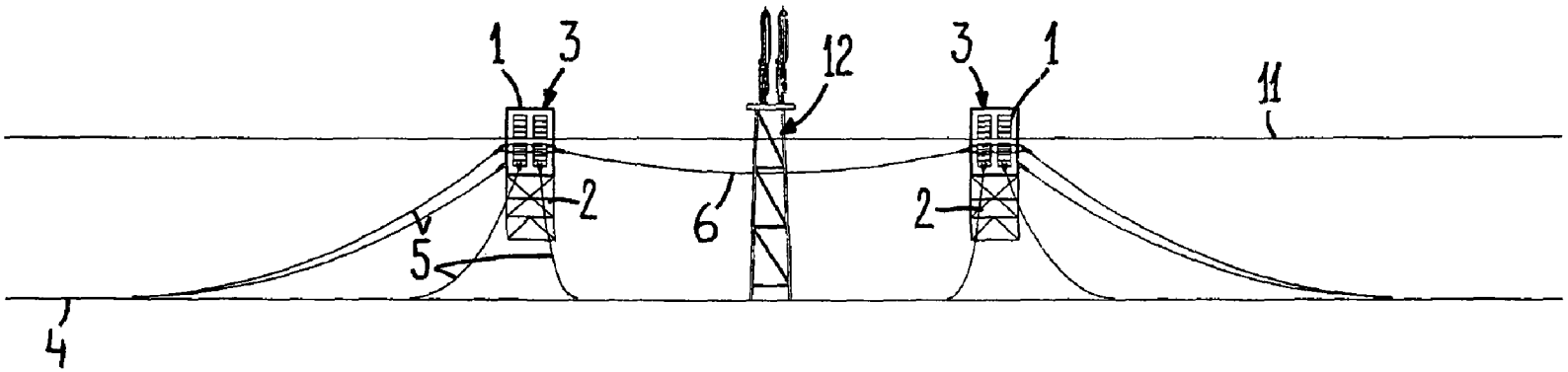
FIG. 1 shows the general arrangement of an embodiment of the mooring system of the invention when not in use, in a side elevational view.
Figure 2:
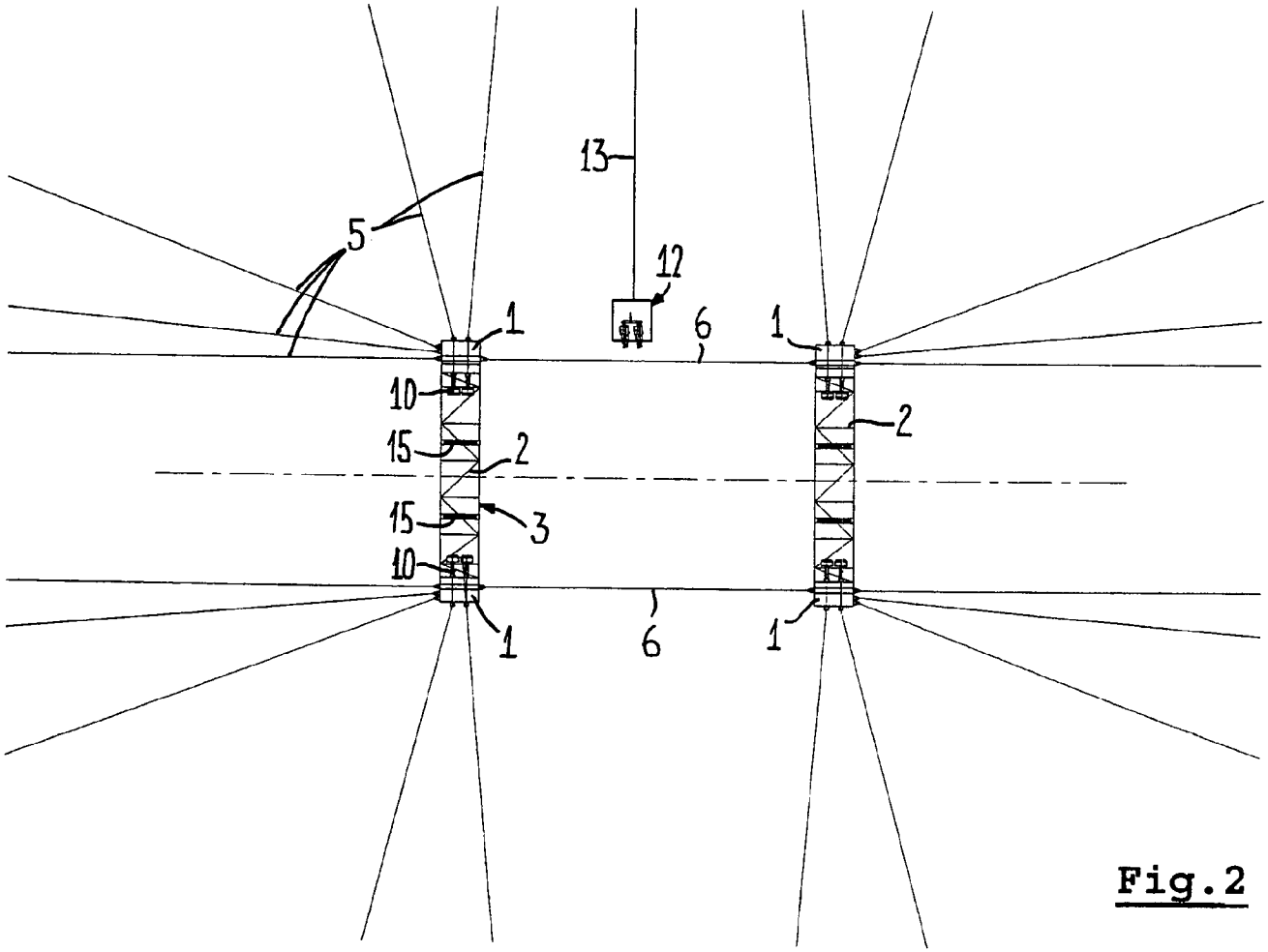
FIG. 2 shows a top plan view of FIG. 1.

In the figures an embodiment of the system having aspects of the invention is shown with the main elements to be installed at the offshore site. Firstly referring to FIG. 3 a pair of opposite semi-submersible floating mooring bodies 1 is provided. These bodies 1 are interconnected by a frame member 2 for defining therewith a substantially U-shaped mooring element 3. These mooring bodies 1 are anchored to the seabed 4 by a plurality of anchor lines 5 (see FIGS. 1 and 2).

Each pair of mooring bodies 1 determines a mooring area for a vessel 16. Preferably, the number of anchor lines 5 is selected such as to provide each individual mooring body 1 with its own means for keeping it stationary. Optionally, the mooring bodies 1 at the same side of the mooring area may also be interconnected to each other, e.g. by an anchor leg 6 (see FIGS. 1 and 2).

In order to avoid congestion and clashing of anchor lines under and near the footprint of the vessel 16, it may be desirable to route those anchor legs 6, which depart from a mooring element 3 towards an adjoining mooring element 3, through a guide pipe 7 integrated in that other mooring element (i.e. the body 1 thereof, see detailed view in FIG. 3, in which the upper right part shows a view of a mooring body 1 in correspondence with FIG. 1 and on a larger scale, and the lower part shows a cross-section therethrough on a still larger scale), and then on to its seabed anchoring point, in such a way that no force along the anchor leg axis is exerted by that anchor leg 6 on that other mooring element 2.

Advantageously, such an anchor leg 6 comprises a steel cable which is employed in conjunction with a freesliding member 8 in a hawse pipe 7. The freesliding member 8 may be fitted with a stopper (not illustrated), abutting against the hawse pipe, at the outboard side of the mooring body 1. In this way the distance between the two adjacent mooring elements is practically speaking fixed when the system is installed. Under the action of the various anchor chain forces, the stopper will lose contact with the hawse pipe to allow the anchor chains to "load" the steel cables 6 between the mooring elements (i.e. the semi-submersible mooring bodies thereof), and hence transfer the mooring force from the "aft" semi-submersible mooring body to a seabed anchor point.

Each of the mooring bodies 1 comprises (preferably two) buoyancy tanks 9 interconnected by the frame member 2 which, in an upper position of the system, is located underwater at a depth generally below the vessel keel.

Each buoyancy tank 9 is fitted with at least one fender 10. The configuration is such that at least one fender 10 can be moved transversely (for example by cylinder-piston assemblies) to engage the hull of the vessel. In this way a clamping force is exerted by the combined fenders 10 on the vessel hull and the magnitude of such clamping forces is pre-selected based on the forces occurring in the anchor legs 5 during the offloading operation. It should be clear that the mooring bodies through the fender 10 each are fully and independently locked by friction to the vessel hull.

Figure 3:
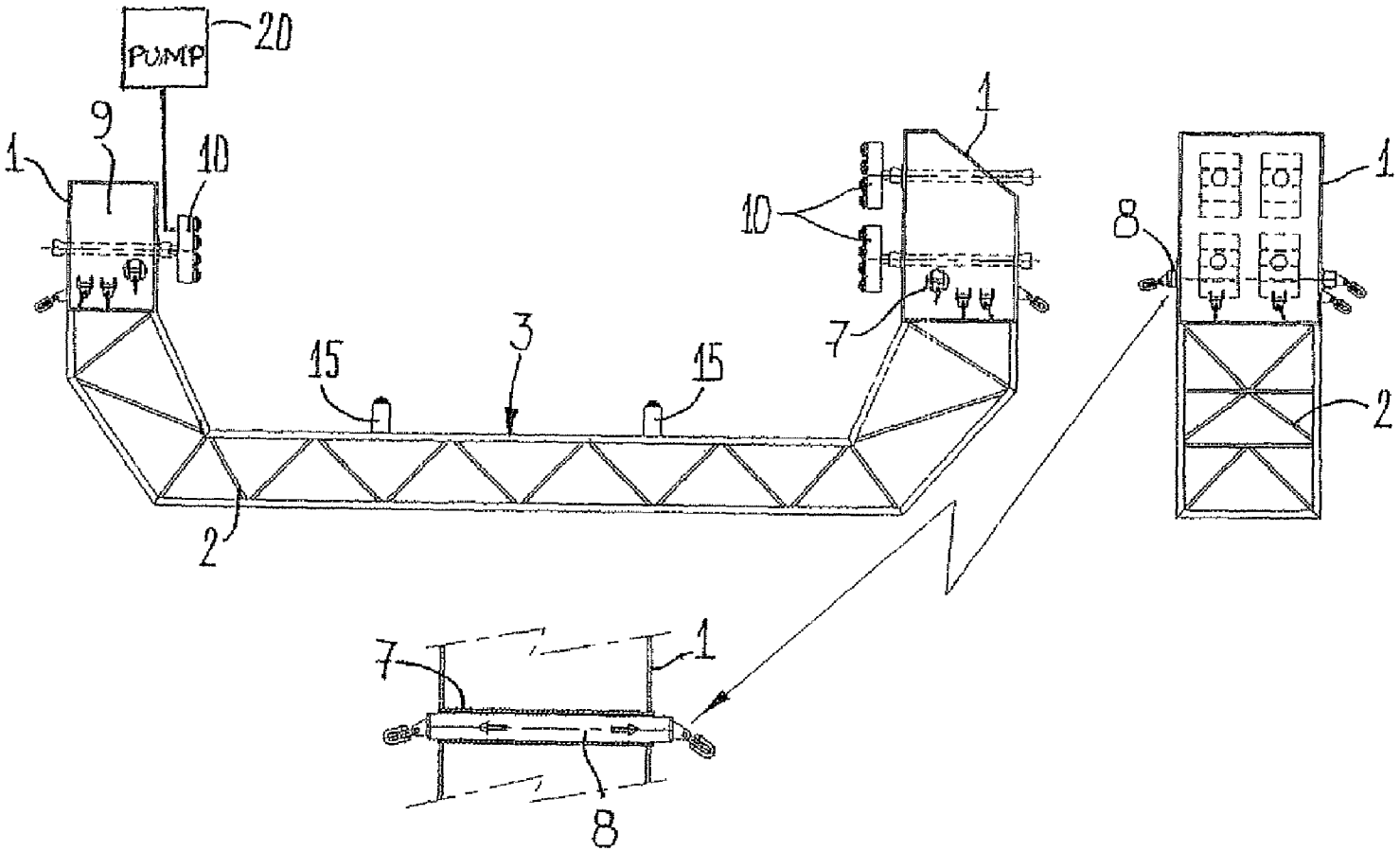
FIG. 3 shows a front elevational view, on a larger scale, of FIG. 1 in combination with a detailed view of a part of the system.

Alternatively, those fenders 10 located under the water level 11 could be combined with a sealable enclosed space, from which water can be pumped with a pump 20 to create an under-pressure and hence additional clamping force on the hull as illustrated in FIG. 3.

Figure 4:
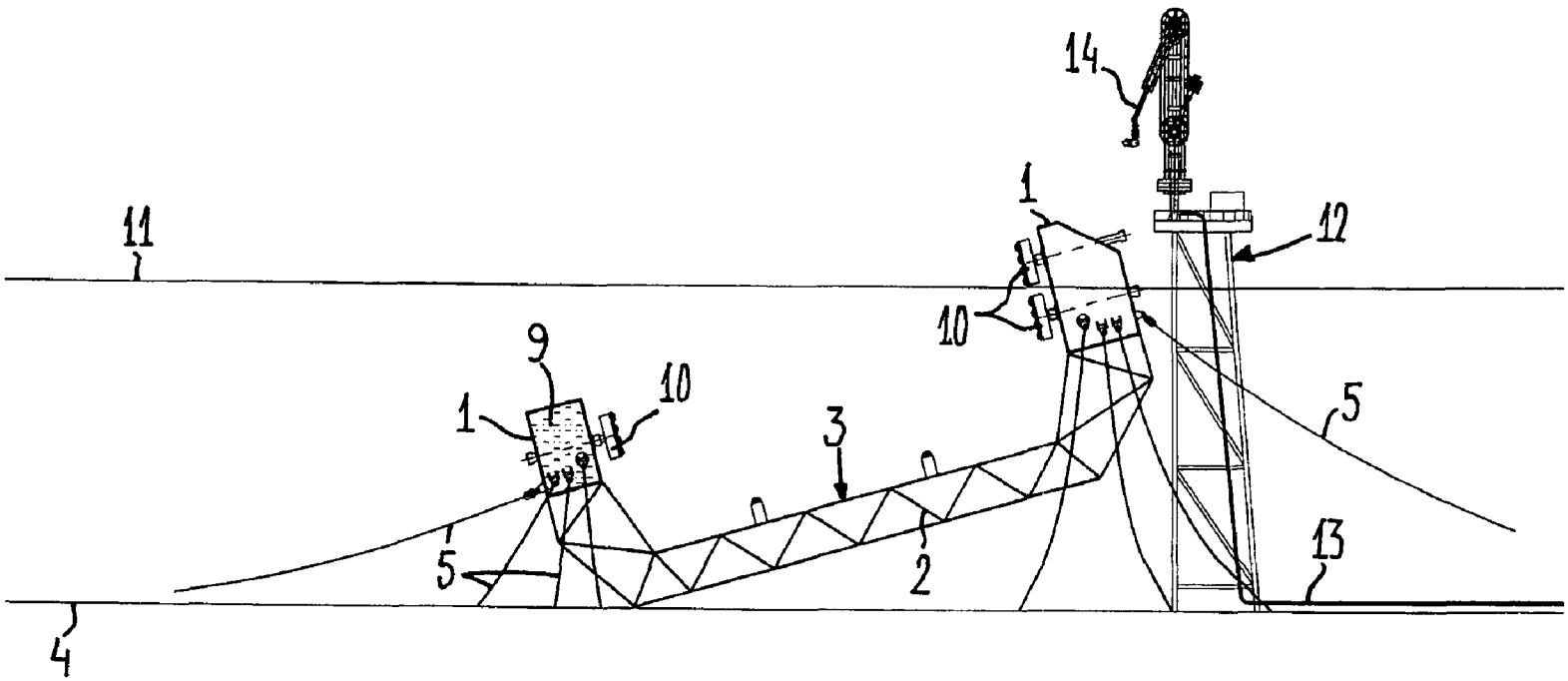
FIG. 4 shows the general arrangement of the mooring system in a lowered position to receive a vessel.
Figure 5:
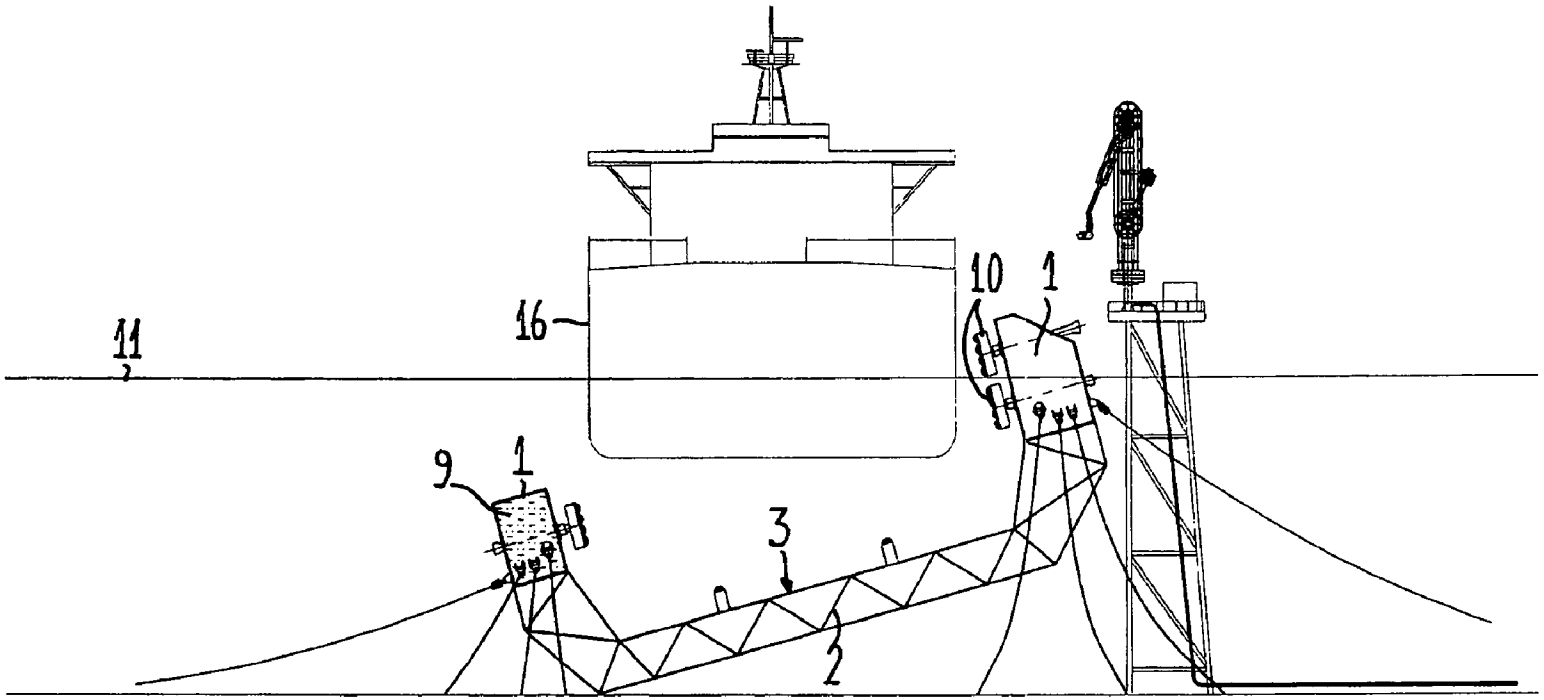
FIG. 5 shows a vessel being manoeuvred into position relative to the mooring system.
Figure 6:
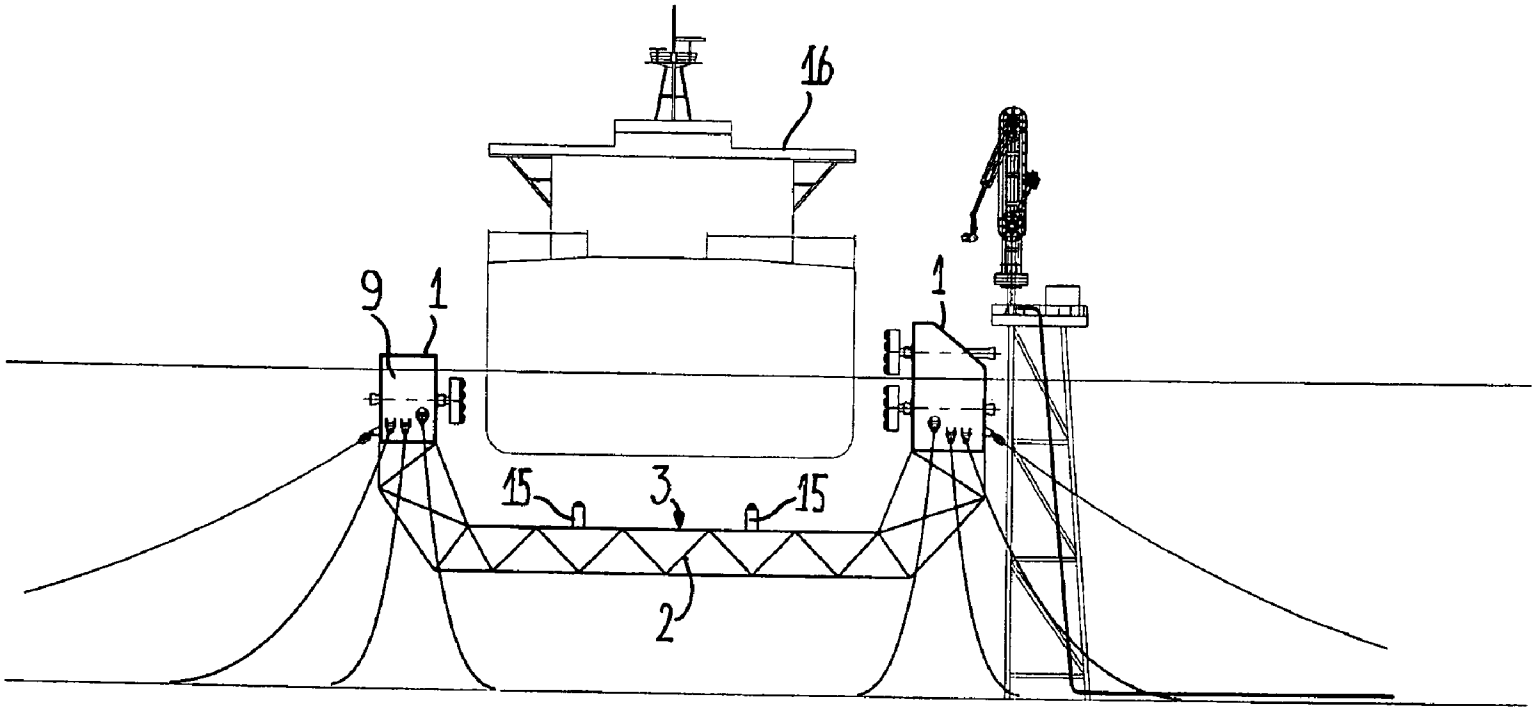
FIG. 6 shows the situation after the mooring system has again assumed its upper position and before components of the system are mobilised to maintain the tanker in position.
Figure 7:
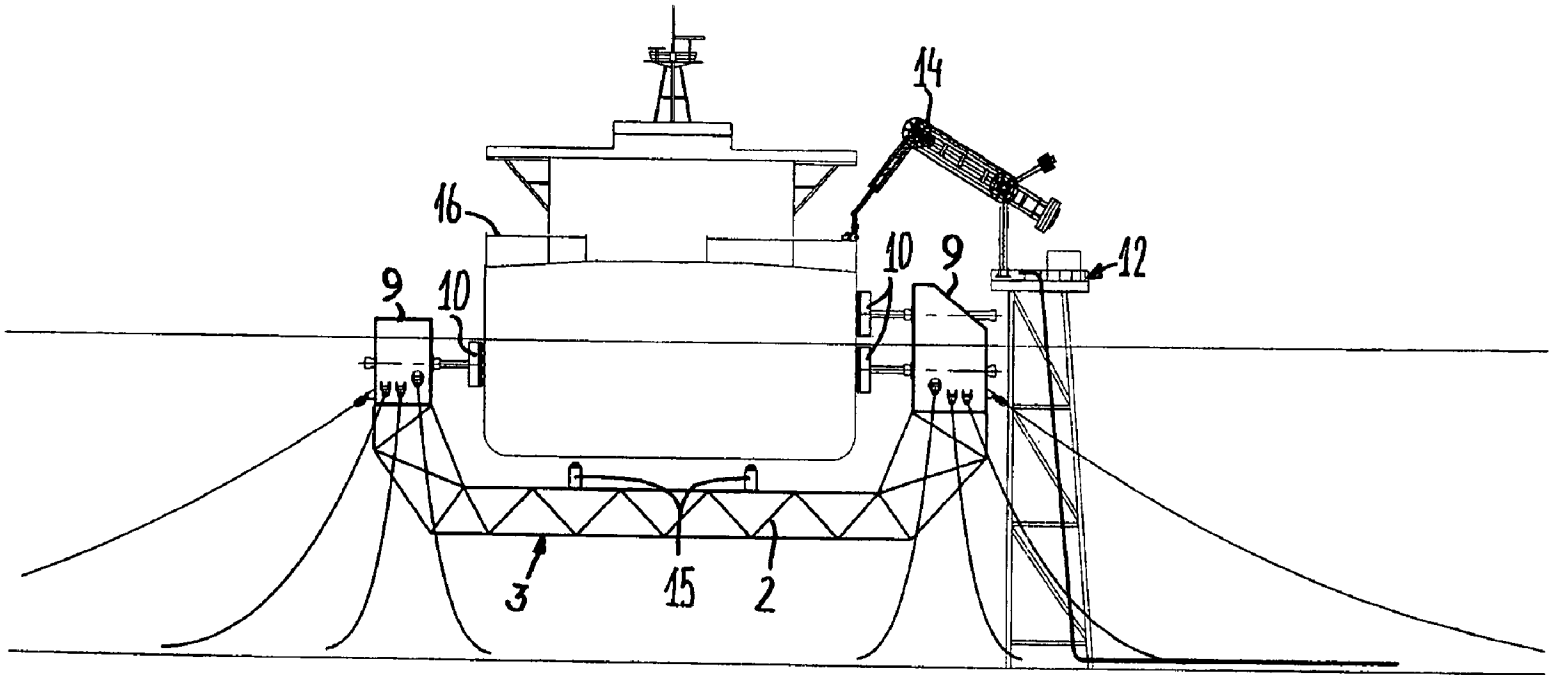
FIG. 7 shows the situation after the mooring system has again assumed its upper position and after components of the system are mobilised to maintain the tanker in position.
Figure 8:
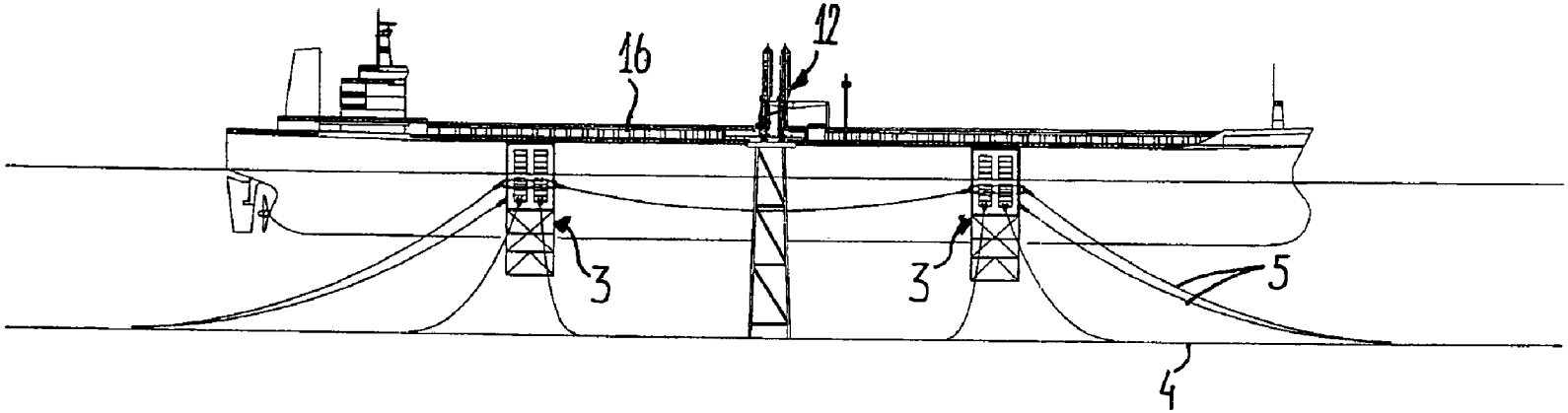
FIG. 8 shows a side elevational view of the system with engaged vessel.
Figure 9:
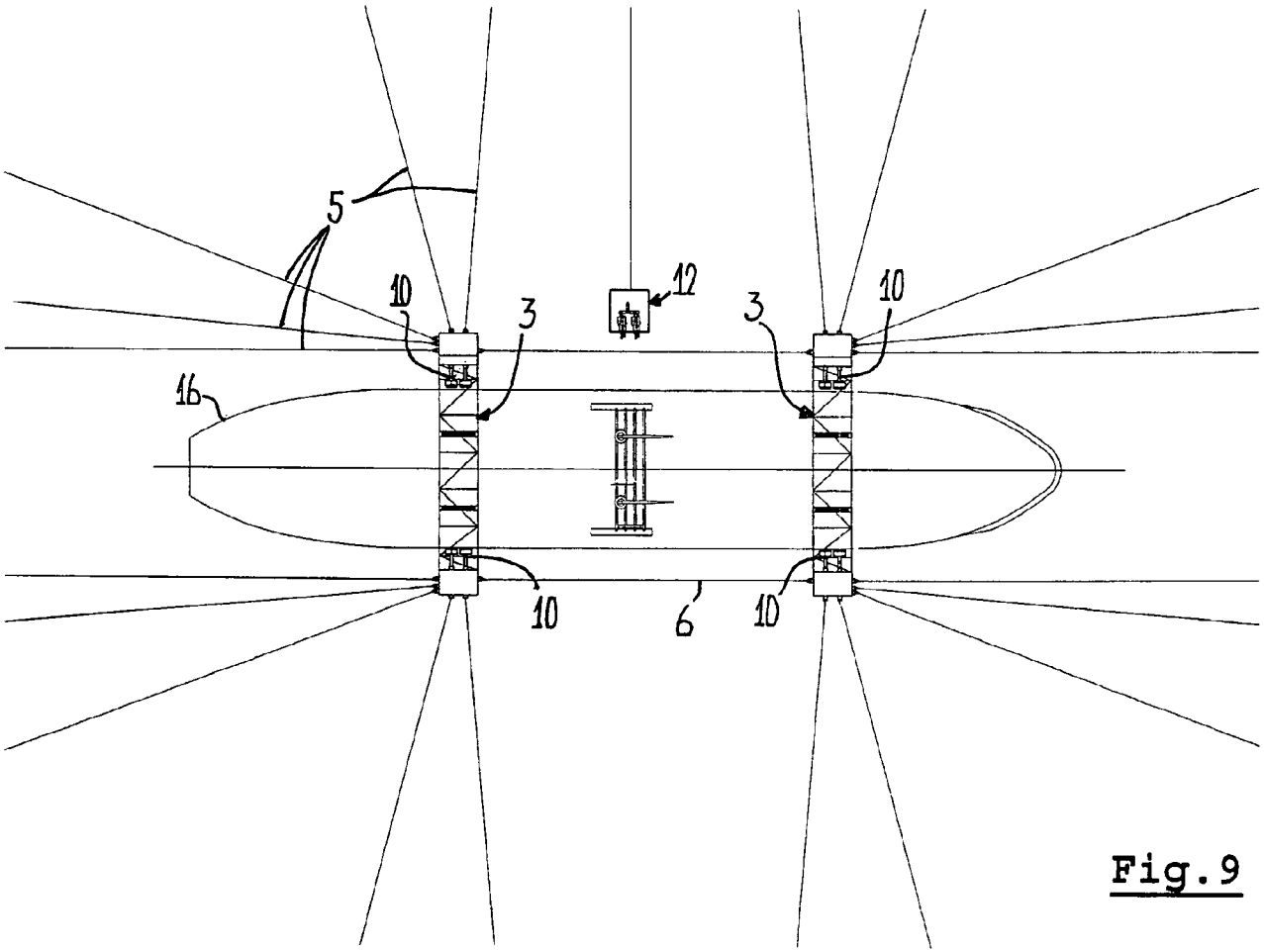
FIG. 9 shows a top plan view of the system with engaged vessel.

The offloading equipment itself is preferably configured as a fixed platform 12 (FIG. 1) connected by submerged or, alternatively, non-submerged pipelines 13 (FIG. 4) to the shore. Loading means, such as hard pipe loading arms 14 complete the offloading equipment.

As shown by way of example in FIGS. 4-7, the method of operation of the mooring system with semi-submersible floating mooring bodies 1 comprises firstly ballasting the buoyancy tanks 9 of the mooring bodies 1 nearest the vessel (which in FIG. 4 will approach from the left), such that the respective side of the frame member 2 is lowered (together with the respective mooring bodies 1) and, if the water is sufficiently shallow, settles temporarily on the seabed 4.

Next (FIG. 5) the vessel 16 is positioned (for example pushed by its tugboats) over the submerged mooring elements 3, towards the fender 10 of the mooring bodies 1 opposite the now lowered mooring bodies. In the illustrated embodiment part of these fender 10 always remain above the water level 11.

Then (FIG. 6) the buoyancy tanks of the lowered mooring bodies 1 are emptied and the frame member 2 again rises towards the surface, until bumpers 15 provided thereon will make contact with the underside of the hull of the vessel 16.

Finally (FIG. 7) the fender 10 are stroked out to engage the hull of the vessel 16.

As an alternative to the shown ballasting system, the lowering of the mooring bodies 1 on one side of the frame member 2 can also be achieved by installing a winch (not shown) on said mooring bodies and hoisting a heavy ballast weight or even connecting the winch line at its free end to an anchor pile driven into the seabed 4.

In the embodiment described above, each semi-submersible mooring body 1 is anchored individually to the seabed 4. In order to increase the holding capacity of the overall mooring system, more anchor legs can be added.

The invention is not restricted to the above described embodiment which can be varied in a number of ways within the scope of the following claims.

The invention claimed is:

1. A system for mooring a vessel at an offshore site, comprising two or more spaced apart floating mooring elements wherein each mooring element comprises two opposite mooring bodies attached to and spaced apart by a frame member, the mooring bodies being positionable to frictionally engage opposite sides of a hull of a vessel, wherein each mooring element is movable between an upper position for engaging the opposite sides of the hull of the vessel and a lower position in which at least one of its mooring bodies is lowered below the upper position for disengaging from the hull of the vessel and wherein the at least two mooring elements are interconnected by connecting lines, such as anchor lines, wherein the connecting lines extend freely movable through channels provided in the mooring elements, and an assembly for maintaining a substantially stationary position of each of the mooring elements relative to the seabed.

2. The system according to claim 1, wherein each mooring element is anchored to the seabed using anchor lines.

3. The system according to claim 1, wherein the mooring bodies comprise at least one buoyancy tank.

4. The system according to claim 3, wherein at least the buoyancy tank of the mooring body which can be lowered comprises a device configured to change the buoyancy of the mooring body.

5. The system according to claim 1, wherein the mooring body which can be lowered is provided with a hoist connected to a ballast weight.

6. The system according to claim 1, wherein the mooring body which can be lowered is provided with a hoist connected to the seabed.

7. The system according to claim 1, wherein the mooring bodies comprise a settable fender configured to frictionally engage the hull of the vessel.

8. The system according to claim 7, and further comprising a plurality of fenders configured to engage the hull of the vessel wherein at least some of the fenders comprise a space opening towards the hull of the vessel and a device configured to lower a pressure inside the space for creating a suction force on the hull.

9. The system according to claim 1, wherein the mooring element is substantially U-shaped with the mooring bodies defining a top of each leg of the U and the frame defining the bottom of the U-shape.

10. The system according to claim 1, wherein the connecting lines are provided with a stopper cooperating with the mooring elements and configured to define at least one position of the connecting lines relative to the mooring elements.

11. A system for mooring a vessel at an offshore site, comprising two or more spaced apart floating mooring elements wherein each mooring element comprises two opposite mooring bodies attached to and spaced apart by a frame member, each mooring body having a fender being positionable to a selected position to frictionally engage opposite sides of a hull of a vessel, wherein each mooring element is movable between an upper position for engaging the opposite sides of the hull of the vessel and a lower position in which at least one of its mooring bodies is lowered below the upper position for disengaging from the hull of the vessel and wherein the two or more mooring elements are interconnected by connecting lines, such as anchor lines, wherein the connecting lines extend freely movable through channels provided in the mooring elements, and an assembly for maintaining a substantially stationary position of each of the mooring elements relative to the seabed.

12. The system of claim 11 and further comprising piston-cylinder assemblies attached to each mooring element and one fender wherein a length of each piston-cylinder assembly is adjusted to frictionally engage the fenders with the opposite sides of the hull.

13. A system for mooring a vessel at an offshore site, comprising two or more spaced apart floating mooring elements wherein each mooring element comprises two opposite mooring bodies attached to and spaced apart by a frame member, each mooring body having a fender, the fenders being positionable to a selected position to provide a frictional engagement of the fenders with the opposite sides of the hull and wherein the fenders are manipulated to create a vacuum between the fenders and the sides of the hull to aid in retaining the fenders to the opposite sides of the hull, wherein each mooring element is movable between an upper position for engaging the opposite sides of the hull of the vessel and a lower position in which at least one of its mooring bodies is lowered below the upper position for disengaging from the hull of the vessel and wherein the two or more mooring elements are interconnected by connecting lines, such as anchor lines, wherein the connecting lines extend freely movable through channels provided in the mooring elements, and an assembly for maintaining a substantially stationary position of each of the mooring elements relative to the seabed.

* * * * *